US008397925B2

(12) United States Patent
Kataoka et al.

(10) Patent No.: US 8,397,925 B2
(45) Date of Patent: Mar. 19, 2013

(54) HOLDING DEVICE FOR COUPLER ADAPTER USED IN RAILCAR

(75) Inventors: Shin Kataoka, Kobe (JP); Satoshi Kondo, Kobe (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 228 days.

(21) Appl. No.: 13/039,674

(22) Filed: Mar. 3, 2011

(65) Prior Publication Data

US 2011/0226718 A1 Sep. 22, 2011

(30) Foreign Application Priority Data

Mar. 18, 2010 (JP) ..... 2010-062371

(51) Int. Cl.
*B60T 17/04* (2006.01)

(52) U.S. Cl. ..... 213/1 R; 213/75 R

(58) Field of Classification Search ..... 213/75 R, 213/1 R, 76, 78, 84
See application file for complete search history.

(56) References Cited

U.S. PATENT DOCUMENTS

| | | | | |
|---|---|---|---|---|
| 1,634,588 | A * | 7/1927 | Le Compte | 213/166 |
| 1,653,140 | A * | 12/1927 | Woernley | 213/100 R |
| 2,569,071 | A * | 9/1951 | Rexford et al. | 213/112 |
| 3,713,546 | A * | 1/1973 | Daugherty, Jr. | 213/43 |
| 3,797,673 | A * | 3/1974 | Daugherty, Jr. | 213/8 |
| 3,836,013 | A * | 9/1974 | Hawthorne | 213/54 |
| 5,890,433 | A * | 4/1999 | Wicks | 105/4.2 |
| 8,297,454 | B2 * | 10/2012 | Kolshorn et al. | 213/75 R |
| 2007/0267377 | A1 * | 11/2007 | McKiernan | 213/75 R |
| 2010/0282919 | A1 * | 11/2010 | McKiernan | 248/53 |
| 2010/0326944 | A1 * | 12/2010 | Gaiguant et al. | 213/220 |
| 2011/0226718 | A1 * | 9/2011 | Kataoka et al. | 213/75 R |

FOREIGN PATENT DOCUMENTS

| | | |
|---|---|---|
| JP | A-07-205810 | 8/1995 |
| JP | A-2007-083875 | 4/2007 |

* cited by examiner

*Primary Examiner* — Jason C Smith

(74) *Attorney, Agent, or Firm* — Oliff & Berridge, PLC

(57) ABSTRACT

A holding device holds a coupler adapter which is connectable to a coupler of a railcar. The holding device includes: a holding frame configured to detachably hold the coupler adapter; a holding frame supporting portion provided at a carbody end portion of the railcar to support the holding frame; a fixing member configured to fix the coupler adapter and the holding frame to the holding frame supporting portion; and a lifting and lowering portion connected to the holding frame to lift and lower the holding frame and the coupler adapter.

8 Claims, 6 Drawing Sheets

HOLDING DEVICE FOR COUPLER ADAPTER USED IN RAILCAR

BACKGROUND OF THE INVENTION

1. Field of the Invention

The present invention relates to a holding device configured to hold a coupler adapter used in a railcar.

2. Description of the Related Art

When a railcar breaks down on a main line or when power is not applied to the railcar in a car depot, the railcar (hereinafter referred to as a "towed vehicle") may be coupled to a towing vehicle to be moved by the towing vehicle. At this time, if a coupler of the towing vehicle and a coupler of the towed vehicle are different in type from each other, these couplers cannot be directly coupled to each other. Therefore, these couplers are coupled to each other via a coupler adapter. As such coupler adapter, for example, Japanese Laid-Open Patent Application Publication No. 2007-83875 (paragraphs 0002 and 0006) discloses a coupling mechanism including a coupling rod and explains that the cost is low and a vehicle tip end portion can be reduced in weight.

Here, the coupler adapter may be stored in a coupler adapter storing portion provided in the vicinity of the coupler of the towed vehicle. To prevent the coupler adapter from falling off, the coupler adapter is fixed to the coupler adapter storing portion by a fixing member. To use the coupler adapter fixed to the coupler adapter storing portion and put the coupler adapter back to the coupler adapter storing portion, the following operations (i) to (vii) needs to be carried out.

(i) Detach the fixing member from the coupler adapter.

(ii) Take out the coupler adapter from the coupler storing portion and put it on the ground.

(iii) Lift up the coupler adapter and attach it to the coupler of the towed vehicle.

(iv) Use the coupler adapter (Couple the towing vehicle and the towed vehicle via the coupler adapter and move the towed vehicle).

(v) Uncouple the towing vehicle and the towed vehicle, detach the coupler adapter from the coupler of the towed vehicle, and put the coupler adapter on the ground.

(vi) Lift up the coupler adapter and put it back to the coupler adapter storing portion.

(vii) Fix the coupler adapter to the coupler storing portion by the fixing member.

Since the coupler adapter requires adequate strength, it is generally heavy (for example, 50 kg). Therefore, among the above operations, the operation of putting the coupler adapter on the ground from the coupler adapter storing portion and the operation of lifting up the coupler adapter to the height of the coupler are burden on an operator and take time. Further, the operations necessary for attaching the coupler adapter need to be carried out by a plurality of operators. Thus, all of the operations require a plurality of operators.

In the coupling mechanism described in the above publication, CFRP is used as a part of the coupling rod to reduce the weight. However, using the CFRP for the coupler adapter increases the cost and is not realistic. Therefore, it is difficult to reduce the weight of the coupler adapter.

SUMMARY OF THE INVENTION

An object of the present invention is to provide a holding device configured to hold a coupler adapter used in a railcar, the holding device allowing to easily and safely carry out operations necessary for attaching the coupler adapter to a coupler.

A holding device according to one embodiment of the present invention includes: a holding frame configured to detachably hold a coupler adapter; a holding frame supporting portion provided at a carbody end portion of the railcar to support the holding frame; a fixing member configured to fix the coupler adapter and the holding frame to the holding frame supporting portion; and a lifting and lowering portion connected to the holding frame to lift and lower the holding frame and the coupler adapter.

In accordance with this configuration, since the operation of lowering the coupler adapter from the holding frame and putting it back to the holding frame can be carried out by using the lifting and lowering portion, the burden of the operator is reduced significantly. Therefore, the operations necessary for attaching the coupler adapter to the coupler can be carried out easily and safely.

DESCRIPTION OF THE PREFERRED EMBODIMENTS

Embodiment 1

Hereinafter, a holding device 100 configured to hold a coupler adapter according to Embodiment 1 will be explained in reference to FIGS. 1A to 5C.

Figure 1A:
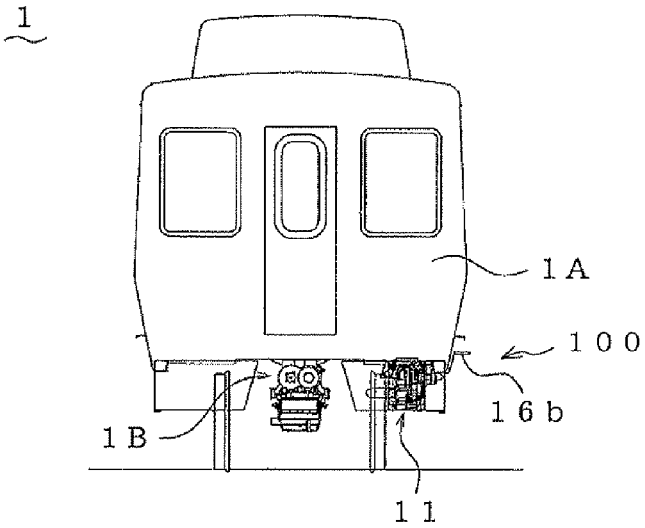
FIG. 1A is a front view of a railcar according to Embodiment 1.
Figure 1B:
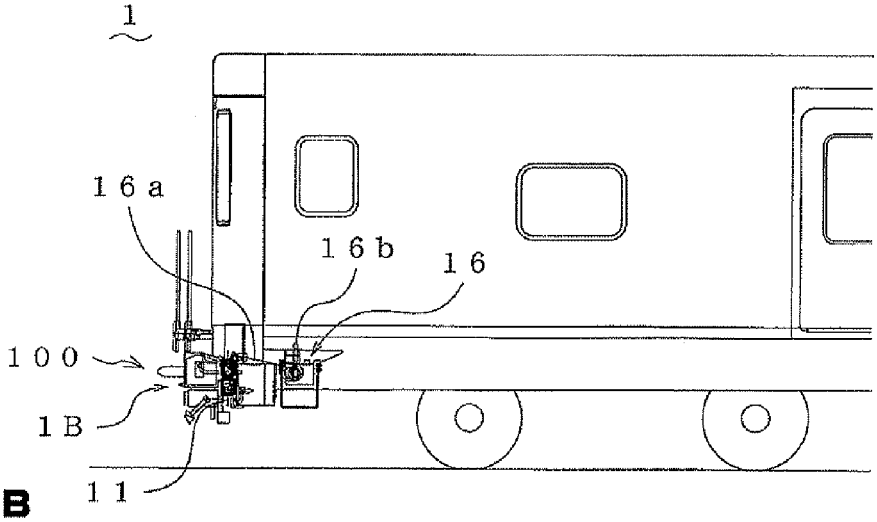
FIG. 1B is a side view of the railcar according to Embodiment 1.
Figure 1C:
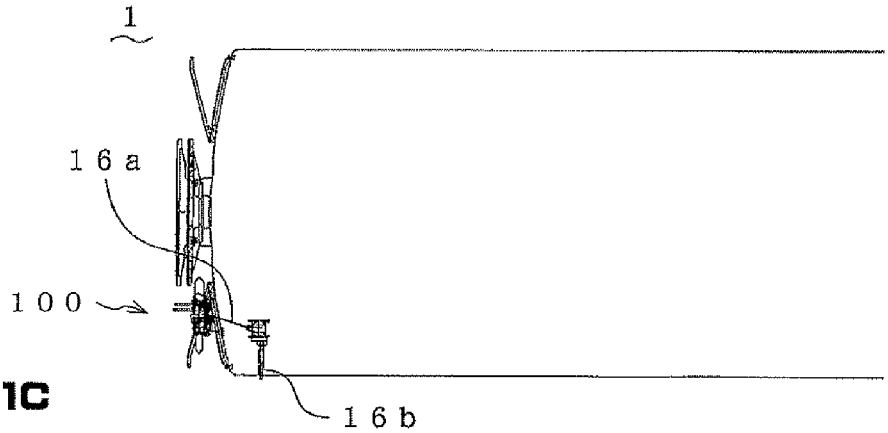
FIG. 1C is a plan view of the railcar according to Embodiment 1.
Figure 2A:
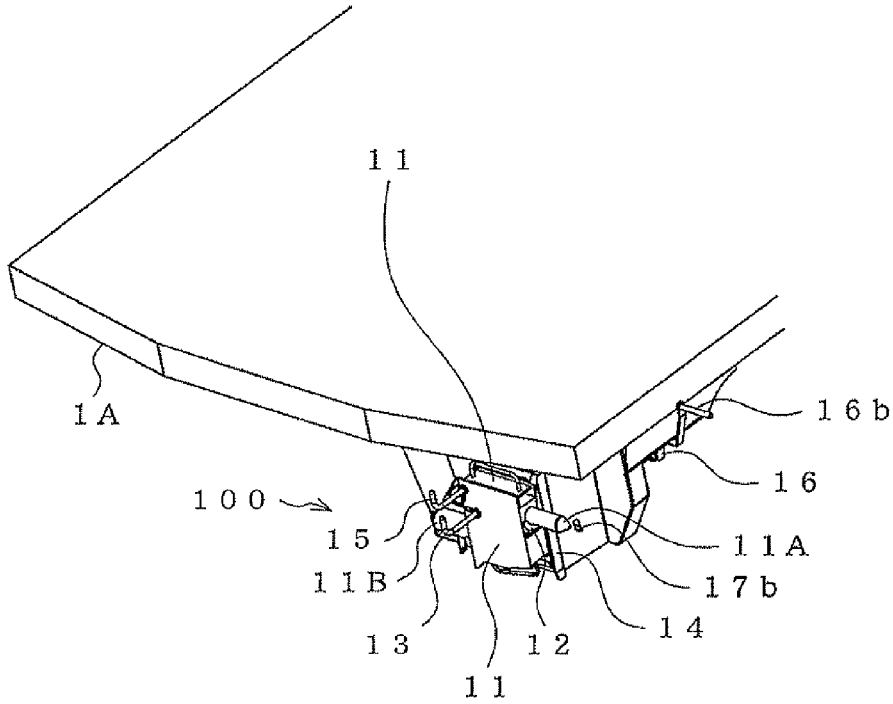
FIG. 2A is a perspective view of a coupler adapter in a stored state.
Figure 2B:
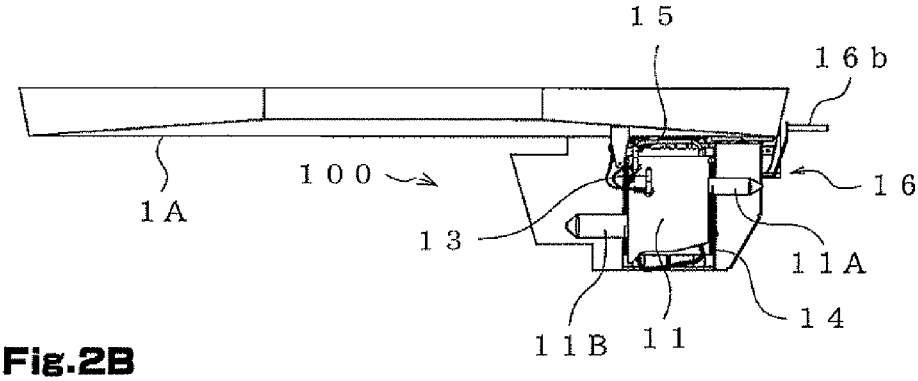
FIG. 2B is a front view of the coupler adapter in the stored state.

As shown in FIGS. 1A to 1C, the holding device 100 configured to hold the coupler adapter according to the present embodiment is provided at a front end portion (or a rear end portion depending on a travelling direction) of a railcar 1 (towed vehicle) and in the vicinity of a coupler 1B. As shown in FIGS. 2A and 2B, the holding device 100 according to the present embodiment is a device configured to hold a coupler adapter 11 and includes a holding frame 12, a first fixing member 13, a holding frame supporting portion 14, a second fixing member 15, and a winch 16 constituting a lifting and lowering portion. Hereinafter, the coupler adapter 11 will be explained at first, and respective components of the holding device 100 will be then explained in order.

Figure 3A:
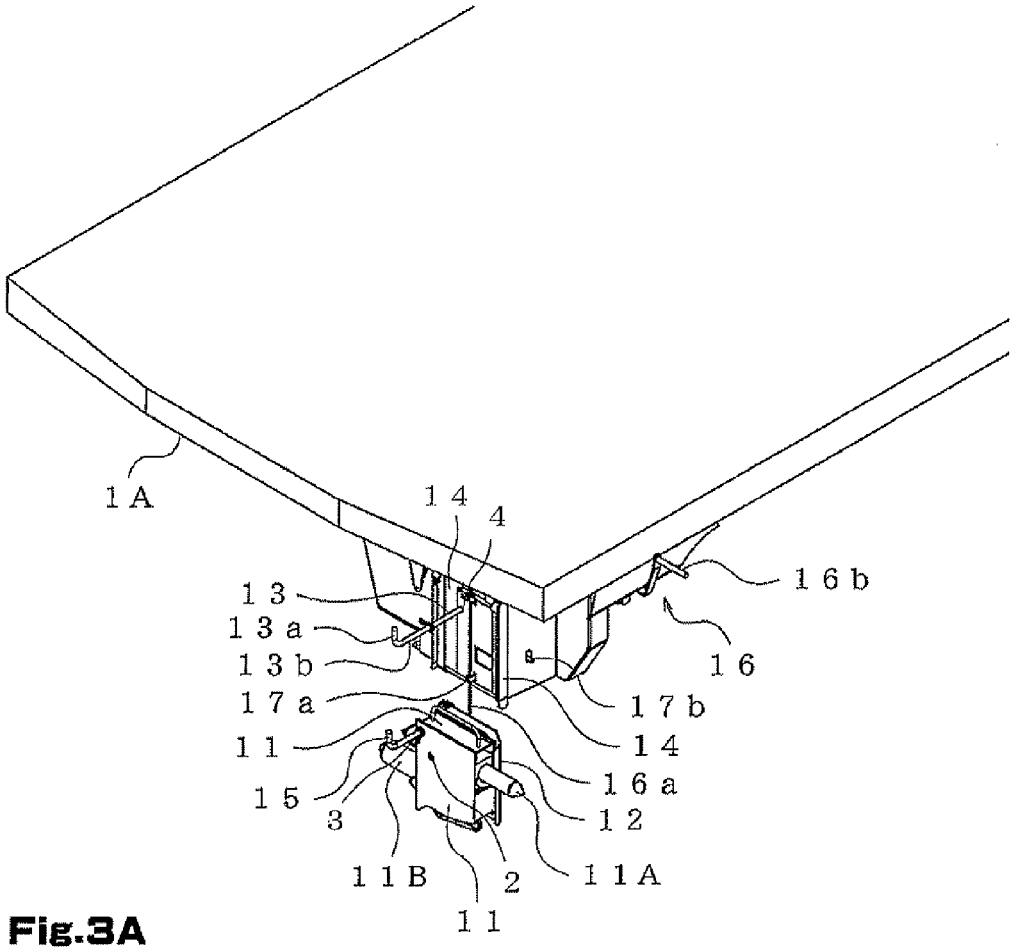
FIG. 3A is a perspective view of the coupler adapter in a hung state.
Figure 3B:
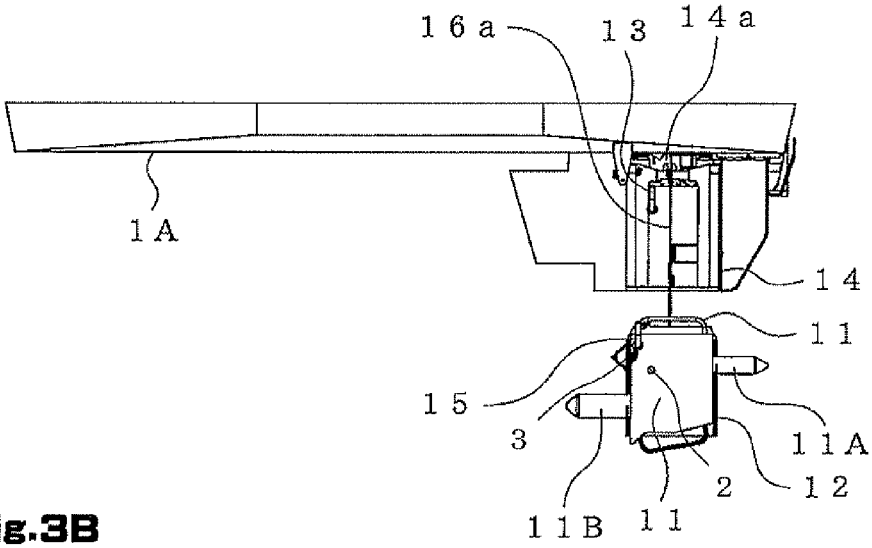
FIG. 3B is a front view of the coupler adapter in the hung state.

The coupler adapter 11 is a device configured to couple couplers to each other, the couplers being different in type from each other. As shown in FIGS. 3A and 3B, the coupler adapter 11 includes a first coupling portion 11A coupled to the coupler of the towing vehicle and a second coupling portion 11B coupled to the coupler 1B of the railcar 1 that is the towed vehicle. Each of the first coupling portion 11A and the second coupling portion 11B is formed in a columnar shape from a base end portion to a center portion and is formed in a conical shape at a tip end portion. A first through hole 2 and a second through hole 3 are formed on the coupler adapter 11. The coupler adapter 11 according to the present embodiment is basically the same in configuration as an existing coupler adapter which has been used so far. Therefore, even if the holding device 100 according to the present embodiment is newly adopted, it is unnecessary to change the existing coupler adapter.

Figure 4A:
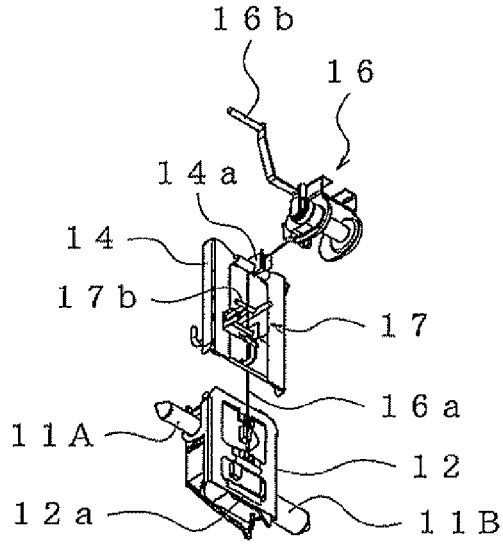
FIG. 4A is a diagram showing a positional relation among the coupler adapter, a holding frame, a holding frame supporting portion, and a winch.
Figure 4B:
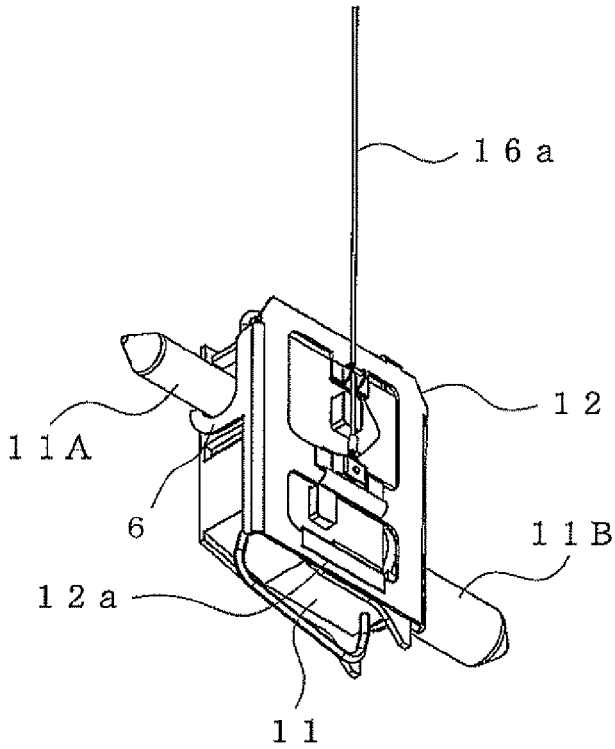
FIG. 4B is an enlarged view of the coupler adapter and the holding frame.
Figure 5A:
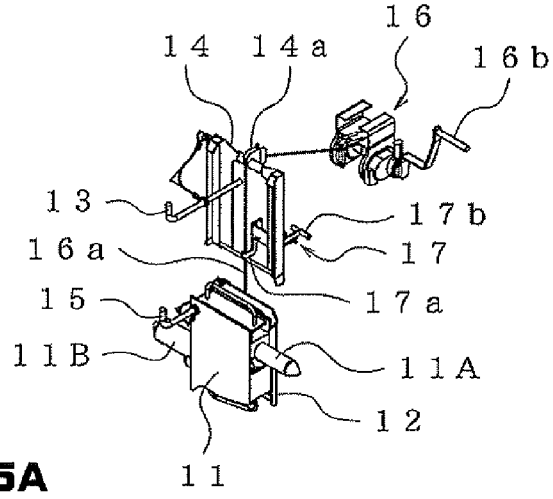
FIG. 5A is an explanatory diagram showing an operation procedure of attaching the coupler adapter.
Figure 5B:
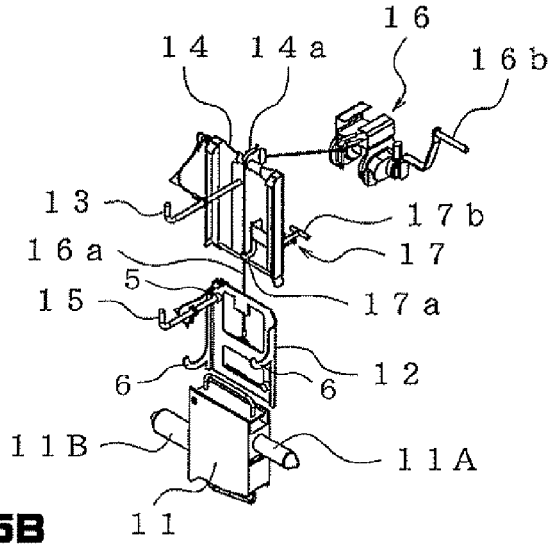
FIG. 5B is an explanatory diagram showing the operation procedure of attaching the coupler adapter.
Figure 5C:
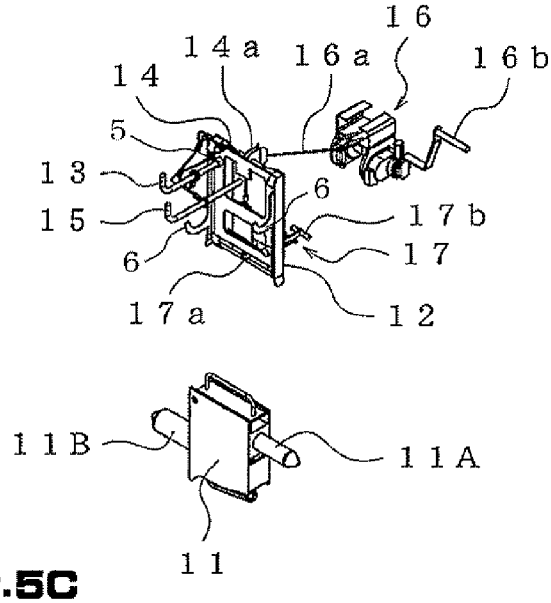
FIG. 5C is an explanatory diagram showing the operation procedure of attaching the coupler adapter.

The holding frame 12 is a member configured to directly hold the coupler adapter 11. As shown in FIGS. 4A and 4B, the holding frame 12 has a rectangular outer edge and is formed in a figure of 8. As shown in FIG. 5B for example, the holding frame 12 includes two holding members 6. These holding members 6 are provided at positions respectively corresponding to the first coupling portion 11A and second coupling portion 11B of the coupler adapter. Each of the holding members 6 is formed in a U shape having a predetermined depth. The depths of the holding members 6 respectively correspond to about half a diameter of the first coupling portion 11A and about half a diameter of the second coupling portion 11B. As shown in FIGS. 5B and 5C, a second screw hole 5 is formed in the vicinity of one upper corner of the holding frame 12. As shown in FIG. 4B, a below-described winch wire 16*a* is coupled to a rear surface of the holding frame 12, and an engaged portion 12*a* is formed at a lower portion of the holding frame 12. As shown in FIG. 3B, in a state where the coupler adapter 11 is held by the holding frame 12, a lower end edge of the holding frame 12 is located higher than a lower end edge of the coupler adapter 11. A vertical distance between these lower end edges is larger than the depth of the holding member 6.

The first fixing member 13 is a member configured to fix the coupler adapter 11 and the holding frame 12 to a carbody 1A (holding frame supporting portion 14). As shown in FIG. 3A, the first fixing member 13 is a rod-like member having an L shape and includes a holding portion 13*a* held by an operator, a rod-like portion 13*b*, and a tip end screw portion, not shown. By inserting the first fixing member 13 through the first through hole 2 of the coupler adapter 11, the tip end screw portion can be screwed into a first screw hole 4 which is formed on the carbody 1A and located on a deep side of the first through hole 2. With this, the coupler adapter 11 and the holding frame 12 are fixed to the carbody 1A (holding frame supporting portion 14).

The holding frame supporting portion 14 is a rectangular frame-shaped member fixed to the carbody 1A. As shown in FIG. 5A for example, the holding frame supporting portion 14 includes an engaging portion 17 configured to prevent the holding frame 12 from falling off. The engaging portion 17 includes a movable engaging portion 17*a* and a lever 17*b*. The movable engaging portion 17*a* is configured to engage with the engaged portion 12*a* of the holding frame 12. Therefore, the holding frame 12 (coupler adapter 11) does not fall off even if pull force by the winch wire 16*a* is lost by the breakdown of the below-described winch 16 or the winch wire 16*a* is cut off. By operating the lever 17*b*, the engagement between the movable engaging portion 17*a* and the engaged portion 12*a* can be released.

The second fixing member 15 is a member configured to fix the coupler adapter 11 to the holding frame 12. As shown in FIG. 5C for example, the second fixing member 15 is substantially the same in configuration as the first fixing member 13. The coupler adapter 11 can be fixed to the holding frame 12 by inserting the second fixing member 15 through the second through hole 3 of the coupler adapter 11 and screwing the tip end screw portion, not shown, into the second screw hole of the holding frame 12.

The winch 16 is a device (lifting and lowering portion) configured to pay out or roll up the winch wire 16*a* to lift and lower the holding frame 12 and the coupler adapter 11. As shown in FIG. 5A for example, paying-out and rolling-up of the winch wire 16*a* are carried out by operating an operating lever 16*b* located at a side portion of the carbody 1A. A first guide portion 14*a* is formed at an upper portion of the holding frame supporting portion 14, and the winch wire 16*a* hangs the first guide portion 14*a*. With this, the winch wire 16*a* can be guided by the first guide portion 14*a* to stably lift and lower the coupler adapter 11 in a substantially vertical direction.

Next, a procedure of attaching the coupler adapter 11 to the coupler will be explained in reference to FIGS. 5A to 5C.

First, as shown in FIG. 5A, the first fixing member 13 is taken out from the coupler adapter 11 and the holding frame 12, and the lever 17*b* is operated to release the engagement between the movable engaging portion 17*a* and the engaged portion 12*a*. Next, by operating the winch 16, the winch wire 16*a* is paid out to put the coupler adapter 11 and the holding frame 12 on the ground.

Then, as shown in FIG. 5B, the second fixing member 15 is taken out from the coupler adapter 11 and the holding frame 12. At this time, the lower end edge of the holding frame 12 does not contact the ground. This is because in a state where the coupler adapter 11 is held by the holding frame 12, the lower end edge of the holding frame 12 is located higher than the lower end edge of the coupler adapter 11. Next, only the holding frame 12 is put on the ground by the winch 16. With this, the first coupling portion 11A and the second coupling portion 11B can be detached from the holding members 6 without lifting the coupler adapter 11. This is because the vertical distance between the lower end edge of the holding frame 12 and the lower end edge of the coupler adapter 11 is larger than the depth of the holding member 6. Thus, the coupler adapter 11 can be completely detached from the holding frame 12.

Then, as shown in FIG. 5C, the winch wire 16*a* is rolled up to put the holding frame 12 back to an initial position, and the first fixing member 13 and the second fixing member 15 are attached to original positions. With this, the holding frame 12 is again fixed to the holding frame supporting portion 14. Thus, the first fixing member 13, the second fixing member 15, and the holding frame 12 are prevented from being lost.

Then, the coupler adapter 11 is attached to the coupler 1B of the towed vehicle to couple the towed vehicle and the towing vehicle. After using the coupler adapter 11, a procedure opposite the above procedure is carried out to fix the coupler adapter 11 to the holding frame supporting portion 14. To be specific, after the coupler adapter 11 is put on the ground once, the coupler adapter 11 is mounted on the holding frame 12 to be fixed by the second fixing member 15.

Next, the holding frame 12 (coupler adapter 11) is lifted by the winch 16 up to the holding frame supporting portion 14. Lastly, the holding frame 12 (coupler adapter 11) is fixed to the holding frame supporting portion 14 by the first fixing member 13.

As above, in accordance with the holding device 100 of the present embodiment, the operator does not have to lift the coupler adapter 11 with his/her hands in the operations of putting down the coupler adapter 11 from the holding frame supporting portion 14 and fixing the coupler adapter 11 to the holding frame supporting portion 14. Therefore, the burden of the operator in the entire operations necessary for attaching the coupler adapter 11 to the coupler can be reduced. In addition, the operating time can be reduced significantly, and the operations can be carried out by fewer operators.

Embodiment 2

Figure 6A:
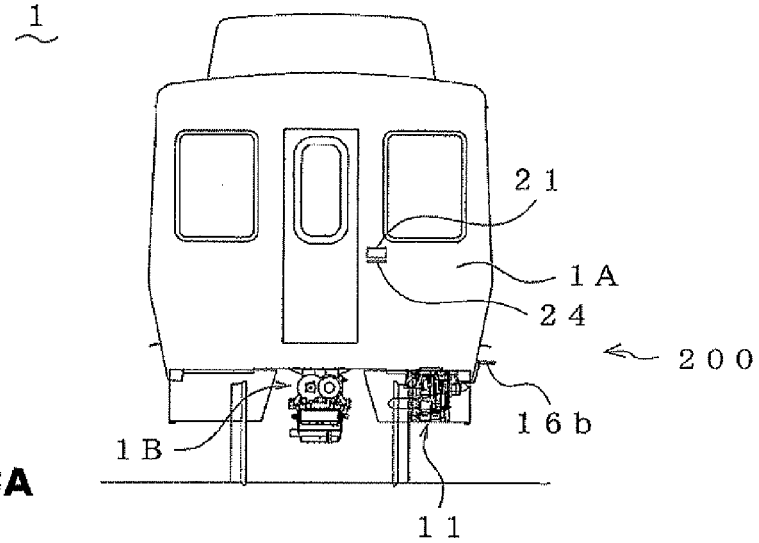
FIG. 6A is a front view of the railcar to which a second guide portion according to Embodiment 2 is not attached.

Next, a holding device 200 configured to hold the coupler adapter according to Embodiment 2 will be explained in reference to FIGS. 6A to 6C. The holding device 200 of the present embodiment is substantially the same in configuration as the holding device 100 according to Embodiment 1 but further includes a second guide portion 22. The second guide portion 22 is attached to a guide attaching portion 21 formed on a front surface of the carbody 1A shown in FIG. 6A. To be specific, the second guide portion 22 is located between the coupler 1B and the coupler adapter 11 and above the coupler 1B and the coupler adapter 11.

Figure 6B:
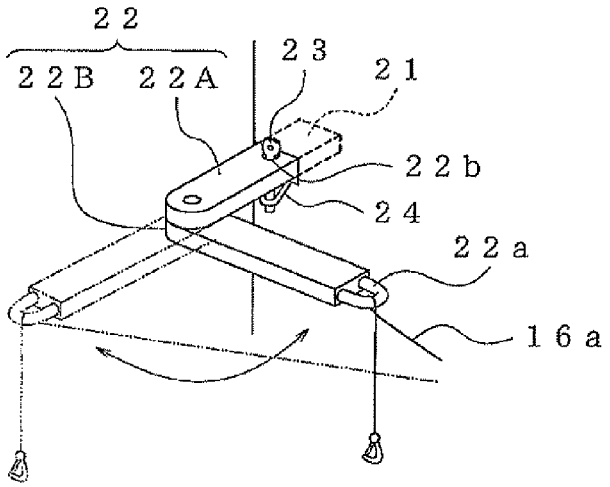
FIG. 6B is a perspective view of the second guide portion according to Embodiment 2.

As shown in FIG. 6B, the second guide portion 22 includes a first member 22A, a second member 22B, and a wire guide portion 22*a*.

The first member 22A fits in the guide attaching portion 21 which is formed on the carbody 1A to have a concave shape. A through hole portion 22*b* is formed on the first member 22A. When in use, a fixing pin 23 is inserted through the through hole portion 22*b* and a pin receiving portion 24 formed on the carbody 1A. Therefore, the first member 22A is prevented from being taken out from the guide attaching portion 21.

Figure 6C:
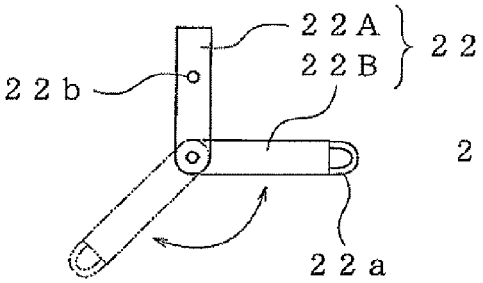
FIG. 6C is an explanatory diagram of the second guide portion according to Embodiment 2.
Figure 6D:
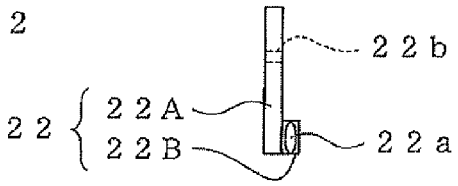
FIG. 6D is an explanatory diagram of the second guide portion according to Embodiment 2.

As shown in FIGS. 6C and 6D, the second member 22B is pivotally attached to a tip end of the first member 22A. Therefore, the second guide portion 22 can be folded when not in use and can be stored in a small space.

The wire guide portion 22*a* is located at a tip end of the second member 22B, and the winch wire 16*a* is inserted through the wire guide portion 22*a*. To be specific, in the present embodiment, the winch wire 16*a* extending from the winch 16 is coupled to the rear surface of the holding frame 12 through the wire guide portion 22*a*.

Since the holding device 200 according to the present embodiment is configured as above, the holding frame 12 and the coupler adapter 11 can be hung upwardly by rolling up the winch wire 16*a* by the winch 16, and the coupler adapter 11 can be coupled to the coupler without putting the coupler adapter 11 on the ground.

The following will focus on the second member 22B. First, an angular position of the second member 22B is appropriately adjusted to hang the holding frame 12 and the coupler adapter 11 up to the vicinity of the holding frame supporting portion 14. Next, the second member 22B is rotated in this state to move the holding frame 12 and the coupler adapter 11 to the vicinity of the coupler 1B. Then, the coupler adapter 11 is attached to the coupler 1B. As above, in accordance with the holding device 200 of the present embodiment, it is unnecessary to lift the coupler adapter 11. Similarly, in the operations of detaching the coupler adapter 11 from the coupler 1B and fixing the coupler adapter 11 to the holding frame supporting portion 14, it is unnecessary to lift the coupler adapter 11. Therefore, the burden of the operator is reduced significantly.

In Embodiments 1 and 2, the first fixing member 13 fixes the holding frame 12 and the coupler adapter 11 to the holding frame supporting portion 14. However, the present invention is not limited to this. For example, the first fixing member 13 may fix only the holding frame 12 to the holding frame supporting portion 14.

In Embodiments 1 and 2, the lifting and lowering portion is the winch 16. However, the present invention is not limited to this. The lifting and lowering portion may be any device as long as it can lift and lower a heavy object. For example, the lifting and lowering portion may be a chain block, a lever block, a hoist, an electric hoist, or an electric winch.

What is claimed is:

1. A holding device configured to hold a coupler adapter which is connectable to a coupler of a railcar, comprising:
- a holding frame configured to detachably hold the coupler adapter;
- a holding frame supporting portion provided at a carbody end portion of the railcar to support the holding frame;
- a fixing member configured to fix the coupler adapter and the holding frame to the holding frame supporting portion; and
- a lifting and lowering portion connected to the holding frame to lift and lower the holding frame and the coupler adapter.

2. The holding device according to claim 1, wherein the fixing member includes a first fixing member configured to fix the holding frame to the holding frame supporting portion and a second fixing member configured to fix the coupler adapter to the holding frame.

3. The holding device according to claim 1, wherein:
- the holding frame includes an engaged portion; and
- the holding frame supporting portion includes an engaging portion configured to engage with the engaged portion of the holding frame to prevent the holding frame from falling off.

4. The holding device according to claim 1, wherein:
- the lifting and lowering portion is a winch; and
- the holding frame supporting portion includes a first guide portion on which a wire of the winch hangs.

5. The holding device according to claim 4, further comprising:
- a second guide portion formed on the carbody end portion and above the coupler and the coupler adapter, wherein
- the second guide portion includes a wire guide portion through which the wire of the winch is able to be inserted.

6. The holding device according to claim 5, wherein:
- the second guide portion includes a first member attached to the carbody end portion and a second member pivotal with respect to the first member; and
- the wire guide portion is provided at the second member.

7. The holding device according to claim 1, wherein in a state where the coupler adapter is held by the holding frame, a lower end edge of the holding frame is located higher than a lower end edge of the coupler adapter.

8. The holding device according to claim 7, wherein:
- the holding frame includes a holding member configured to hold the coupler adapter; and
- a vertical distance between the lower end edge of the holding frame and the lower end edge of the coupler adapter is larger than a depth of the holding member.

* * * * *